US012302981B2

(12) United States Patent
Luu et al.

(10) Patent No.: US 12,302,981 B2
(45) Date of Patent: May 20, 2025

(54) ARTICLE OF FOOTWEAR HAVING A RAND

(71) Applicant: NIKE, Inc., Beaverton, OR (US)

(72) Inventors: Vu Luu, Beaverton, OR (US); Kelly A. O'Connor, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 79 days.

(21) Appl. No.: 18/166,547

(22) Filed: Feb. 9, 2023

(65) Prior Publication Data

US 2023/0276900 A1 Sep. 7, 2023

Related U.S. Application Data

(60) Provisional application No. 63/316,147, filed on Mar. 3, 2022.

(51) Int. Cl.

| | |
|---|---|
| ***A43B 13/00*** | (2006.01) |
| ***A43B 13/04*** | (2006.01) |
| ***A43B 13/14*** | (2006.01) |

(52) U.S. Cl.

CPC ..... *A43B 13/141* (2013.01); *A43B 13/04* (2013.01)

(58) Field of Classification Search

CPC ..... A43B 9/04; A43B 13/00; A43B 13/141; A43B 13/04

USPC ..... 36/17 R

See application file for complete search history.

(56) References Cited

U.S. PATENT DOCUMENTS

| | | | | | |
|---|---|---|---|---|---|
| 2,368,845 | A * | 2/1945 | Kleven | A43B 13/00 | 36/31 |
| 2,569,184 | A * | 9/1951 | Longini | A43B 9/04 | 12/142 F |
| RE28,236 | E * | 11/1974 | Kleven | A43B 13/04 | 36/87 |
| 3,971,145 | A * | 7/1976 | Stegerwald | A43B 5/10 | 36/32 R |
| 4,024,652 | A * | 5/1977 | Brilli | B29D 35/081 | 12/142 RS |
| 4,026,044 | A * | 5/1977 | Senter | A43B 13/28 | 36/145 |
| 4,068,395 | A * | 1/1978 | Senter | A43B 9/00 | 36/83 |
| 4,122,574 | A * | 10/1978 | Karalis | A43B 9/02 | 12/142 RS |
| 4,194,310 | A * | 3/1980 | Bowerman | A43B 5/06 | 36/32 R |
| 4,261,072 | A * | 4/1981 | Senter | A43B 15/00 | 12/142 D |
| 4,783,909 | A * | 11/1988 | Van Doren | A43B 3/242 | 36/68 |
| 2004/0123492 | A1* | 7/2004 | Duclos | A43B 9/04 | 36/25 R |
| 2008/0301886 | A1* | 12/2008 | Earle | A43B 13/04 | 12/142 F |

(Continued)

*Primary Examiner* — Marie D Bays

(74) *Attorney, Agent, or Firm* — Quinn IP Law

(57) ABSTRACT

An article of footwear includes an outsole and an upper secured to the outsole and defining a foot-receiving cavity over the outsole. The article of footwear further includes a rand secured to an exterior surface of the upper; wherein the rand has a first end at a medial side of a heel region of the upper and a second end at a front of a forefoot region of the upper. The rand wraps around a rear of the upper from the first end to the second end, the rand extending along a lateral side of the upper from the first end to the second end.

17 Claims, 9 Drawing Sheets

(56) References Cited

U.S. PATENT DOCUMENTS

| | | | | |
|---|---|---|---|---|
| 2008/0307670 | A1* | 12/2008 | Duclos | A43B 9/04 36/4 |
| 2009/0260259 | A1 | 10/2009 | Berend | |
| 2011/0277350 | A1* | 11/2011 | Huynh | A43B 23/027 36/102 |
| 2013/0036628 | A1* | 2/2013 | Hussey | A43B 3/0078 36/87 |
| 2014/0237858 | A1 | 8/2014 | Adami et al. | |
| 2015/0143720 | A1* | 5/2015 | Avar | A43B 23/0235 36/107 |
| 2016/0007676 | A1* | 1/2016 | Leimer | A43B 13/04 36/103 |
| 2016/0088898 | A1* | 3/2016 | Henderson | A43B 9/06 36/87 |
| 2017/0258179 | A1* | 9/2017 | Conant | A43B 13/141 |
| 2018/0199666 | A1* | 7/2018 | Moriyasu | A43B 23/028 |
| 2018/0317608 | A1* | 11/2018 | Fenato | A43B 9/12 |
| 2019/0365035 | A1* | 12/2019 | Jenkins | A43B 13/12 |
| 2021/0015210 | A1* | 1/2021 | Farr | A43B 15/00 |
| 2021/0186144 | A1* | 6/2021 | Truelsen | A43B 7/142 |
| 2021/0204651 | A1* | 7/2021 | Thompson | A43B 13/04 |
| 2021/0259356 | A1 | 8/2021 | Maselino et al. | |
| 2021/0315319 | A1 | 10/2021 | Klein et al. | |
| 2021/0361028 | A1* | 11/2021 | Ishikawa | A43B 7/142 |
| 2022/0022599 | A1* | 1/2022 | Laverty | A43B 13/223 |
| 2022/0053871 | A1* | 2/2022 | Hartmann | A43B 13/42 |

* cited by examiner

ARTICLE OF FOOTWEAR HAVING A RAND

CROSS-REFERENCE TO RELATED APPLICATIONS

This application claims the benefit of priority to U.S. Provisional Application No. 63/316,147 filed Mar. 3, 2022, which is hereby incorporated by reference in its entirety.

TECHNICAL FIELD

The present disclosure generally relates to an article of footwear, a rand for the article of footwear, and a method of manufacturing the rand.

BACKGROUND

Footwear typically includes a sole structure configured to be located under a wearer's foot to space the foot away from the ground and an upper secured to the sole structure and defining a foot-receiving cavity. Sole structures for athletic footwear may be configured to provide desired cushioning, motion control, and resiliency.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
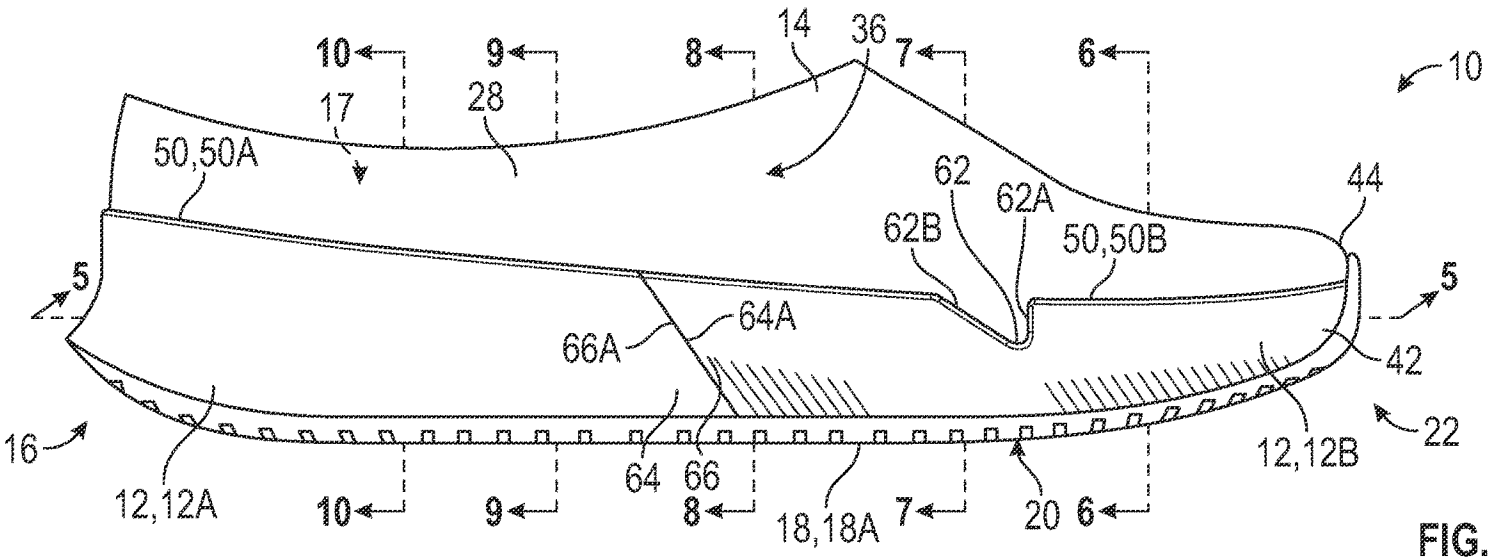
FIG. 1 is a lateral side view of an article of footwear having a rand.

The present disclosure generally relates to an article of footwear that includes a rand configured to provide support to help maintain the position of the foot above a midsole. For example, the rand may provide support during lateral movements, and may be especially supportive when included in footwear that has a midsole disposed within a foot-receiving cavity, such as, but not limited to, a drop-in midsole. The material properties and the geometry of the rand provide support while allowing for flexibility in the various regions of the footwear. Additionally, the footwear may have an outsole that has a geometry that interfits with that of the rand.

In some embodiments, the outsole may be a more durable material, and may be utilized in regions more prone to wear during certain activities, such as the front of the footwear at the medial side.

In an example, an article of footwear includes an outsole and an upper secured to the outsole and defining a foot-receiving cavity over the outsole. The article of footwear further includes a rand secured to an exterior surface of the upper. The rand has a first end at a medial side of a heel region of the upper and a second end at a front of a forefoot region of the upper. The rand wraps around a rear of the upper from the first end to the second end. The rand extends along a lateral side of the upper from the first end to the second end.

In another example, an article of footwear includes an outsole and an upper secured to the outsole and defining a foot-receiving cavity over the outsole. The article of footwear further includes a rand having a first portion and a second portion. The first portion of the rand has at least one material property different than the second portion of the rand. The first portion of the rand is secured to at least a first region of an exterior surface of the upper, and the second portion of the rand is secured to at least a second region of the exterior surface of the upper. For example, the first region may be a heel region and the second region may be a forefoot region. The second portion of the rand is not secured to the first region, and the first portion of the rand is not secured to the second region. Different properties of the rand portions may thus be utilized to influence aspects of the different regions of the upper 14 and the article of footwear.

In still another example, an article of footwear includes an outsole and an upper secured to the outsole and defining a foot-receiving cavity over the outsole. The article of footwear further includes a midsole disposed within the foot-receiving cavity and having an upper peripheral edge. The outsole has an integral rand portion that wraps up along an exterior surface of the upper outward the midsole and extends above the upper peripheral edge of the midsole.

The present disclosure also provides a component of an article of footwear comprising a rand configured to be secured to an exterior surface of an upper for an article of footwear. The rand has a first end configured to be secured at a medial side of a heel region of the upper and a second end configured to be secured at a front of a forefoot region of the upper. The rand is configured to wrap around a rear of the upper from the first end to the second end, and configured to extend along a lateral side of the upper from the first end to the second end.

A method of manufacturing a component of an article of footwear may include molding a first material to form any of the rands, rand portions, and/or rand segments disclosed herein. In some examples, the method may also include molding a second material to form a different portion or segment of the rand than that formed by molding the first material.

The above features and advantages and other features and advantages of the present teachings are readily apparent from the following detailed description of the modes for carrying out the present teachings when taken in connection with the accompanying drawings. It should be understood that even though in the following figures embodiments may be separately described, single features thereof may be combined to additional embodiments.

Referring to the drawings, wherein like reference numbers refer to like components throughout the views, FIG. 1 shows an article of footwear 10 that includes a rand 12 having unique features and properties to provide tuned support and flexibility at the various regions of the article of footwear. In the embodiment shown, the rand 12 has two segments or portions, including a first rand segment 12A and a second rand segment 12B, as describe herein. The segments 12A, 12B may be separate components or may be integrated as a single, one-piece component.

The article of footwear 10 includes an upper 14 and a sole structure 16. The sole structure 16 includes an outsole 18 secured to the upper 14. The outsole 18 has a bottom portion 18A that underlies the upper 14 and includes a ground-contact surface 20 of the sole structure 16. The upper defines a foot-receiving cavity 17 disposed over the bottom portion of the outsole 18. The article of footwear 10 includes a forefoot region 22, a midfoot region 24, and a heel region 26, indicated in FIG. 2. The article of footwear 10 also has a lateral side 28 shown in FIG. 1 and a medial side 30 shown in FIG. 2. Both the upper 14 and the outsole 18 extend in each of the forefoot region 22, the midfoot region 24, and the heel region 26, at the lateral side 28, and at the medial side 30.

Figure 5:
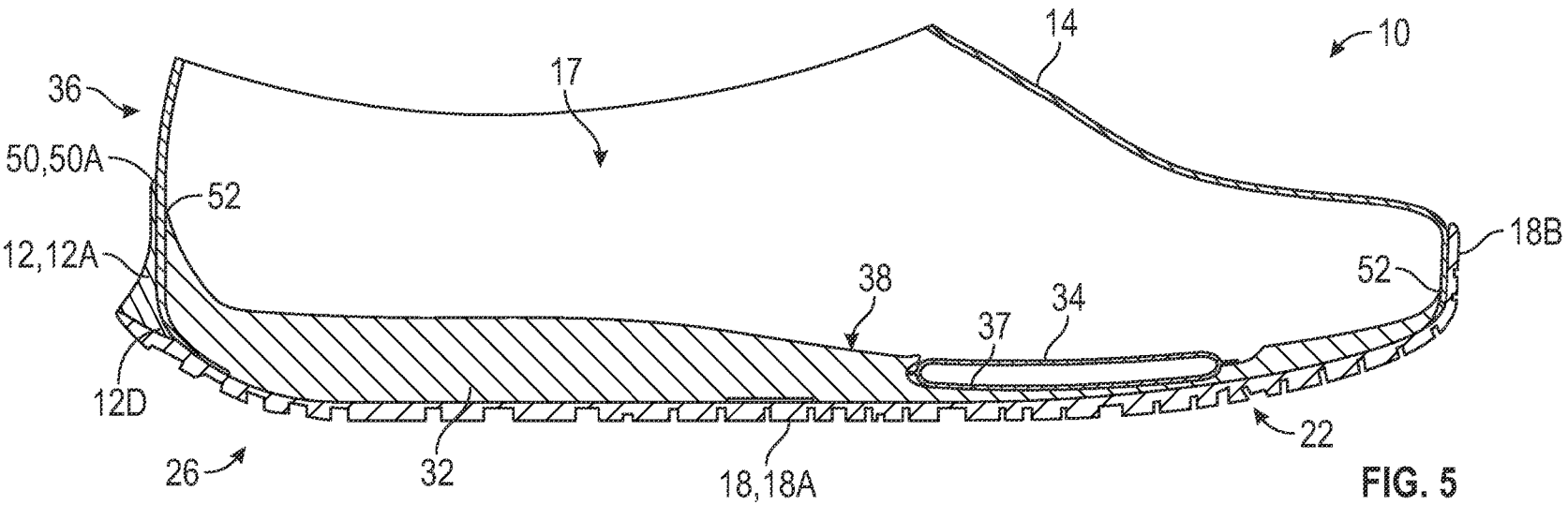
FIG. 5 is a cross-sectional view of the article of footwear of FIG. 1 taken at lines 5-5 in FIG. 1.

Referring to FIG. 5, the sole structure 16 further includes a midsole 32 disposed within the foot-receiving cavity 17. Because it is disposed within the foot-receiving cavity 17, the upper 14 is laterally outward of the midsole 32 at both the medial side 30 and the lateral side 28, at a front 44 of the upper 14, and at a rear 46 of the upper 14, and wraps under the midsole 32. The rand 12 provides peripheral support to help maintain the midsole 32 and the foot thereon centered over the bottom portion 18A of the outsole 18 especially when subjected to lateral (side-to side) forces during wear.

As shown in FIG. 5, the sole structure 16 also includes a fluid-filled bladder 34 nested in a recess 37 at the foot-facing surface 38 of the midsole 32 in the forefoot region 22. The bladder 34 may be pressurized or at ambient pressure, and provides targeted cushioning in the forefoot region 22, such as under the metatarsal phalangeal joints. An insole and/or strobel (not shown) may overlie the midsole 32 and/or the bladder 34 in the foot-receiving cavity 17.

Referring again to FIGS. 1 and 2, the rand 12 is secured to an exterior surface 36 of the upper 14. In the embodiment shown, the rand 12 has a first end 40 at a medial side 30 of the heel region 26 of the upper 14 (see FIG. 2) and a second end 42 at a front 44 of the forefoot region 22 of the upper 14 (see FIGS. 1 and 5). The rand 12 wraps around a rear 46 of the upper 14 from the first end 40 to the lateral side 28 of the upper, and extends along the lateral side 28 of the upper 14 from the heel region 26 to the second end 42 in the forefoot region 22 providing peripheral support along the entire lateral side 28.

Figure 2:
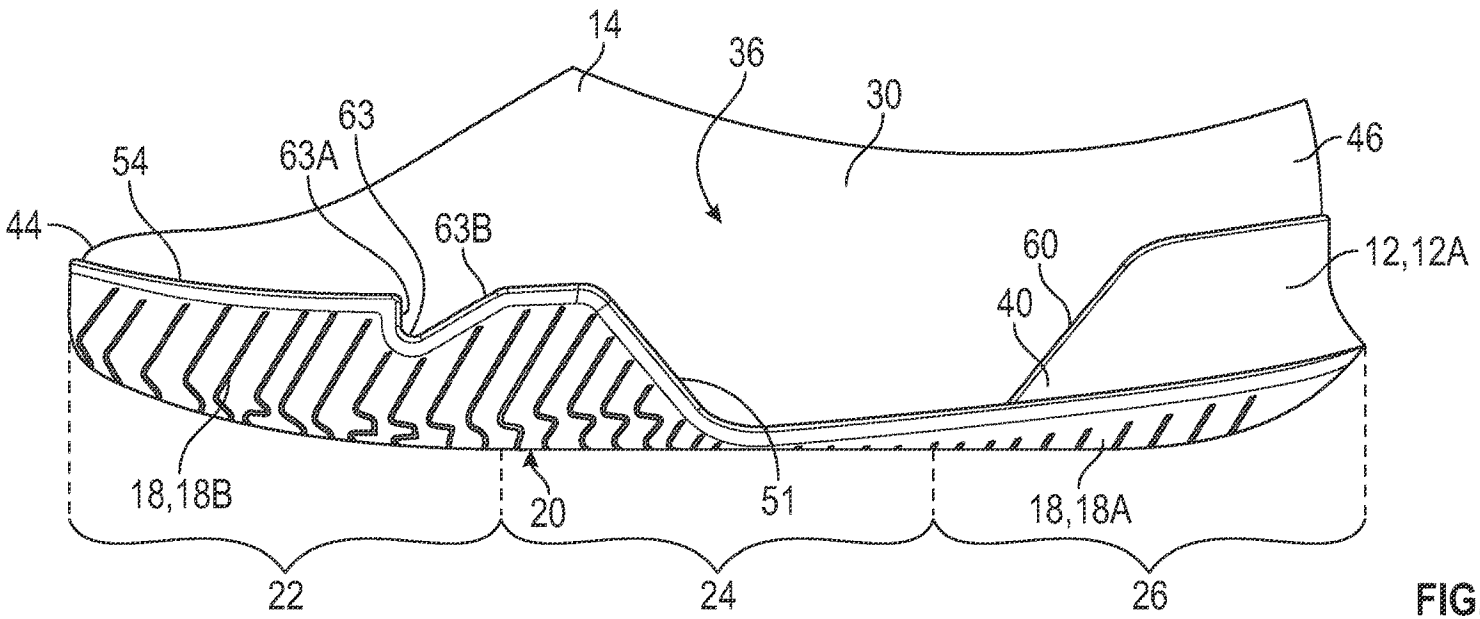
FIG. 2 is a medial side view of the article of footwear of FIG. 1.
Figure 4:
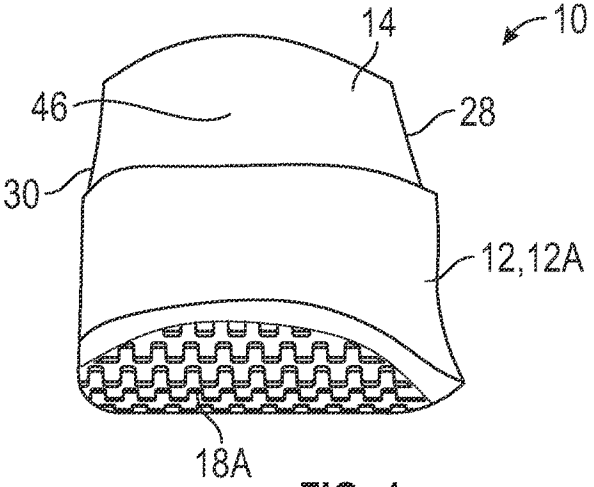
FIG. 4 is a rear view of the article of footwear of FIG. 1.
Figure 3:
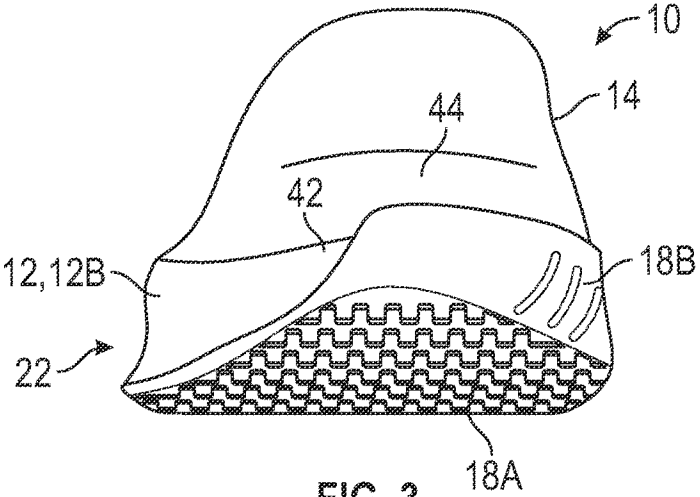
FIG. 3 is a front view of the article of footwear of FIG. 1.

As shown in FIG. 2, the outsole 18 also has a sidewall portion 18B that wraps up from the bottom portion 18A along the upper 14 and is secured to the exterior surface 36 of the upper 14 at the medial side 30 in the forefoot region 22, providing peripheral support. The second end 42 of the rand 12 meets and interfits with the sidewall portion 18B of the outsole 18 at the front 44 of the upper 14 in the forefoot region 22 as shown in FIG. 3.

Together the sidewall portion 18B of the outsole 18 and the rand 12 provide peripheral support at the exterior of the upper 14 along the entire lateral side 28, the entire front 44, and the entire rear 46, and at the medial side 30 in both the forefoot region 22 and the heel region 26, with only a portion of a lower extent of the upper 14 at the medial side 30 at the midfoot region 24 between the first end 40 of the rand 12 and a rear edge 51 of the sidewall portion 18B of the outsole 18 left exposed and unsupported.

Figure 9:
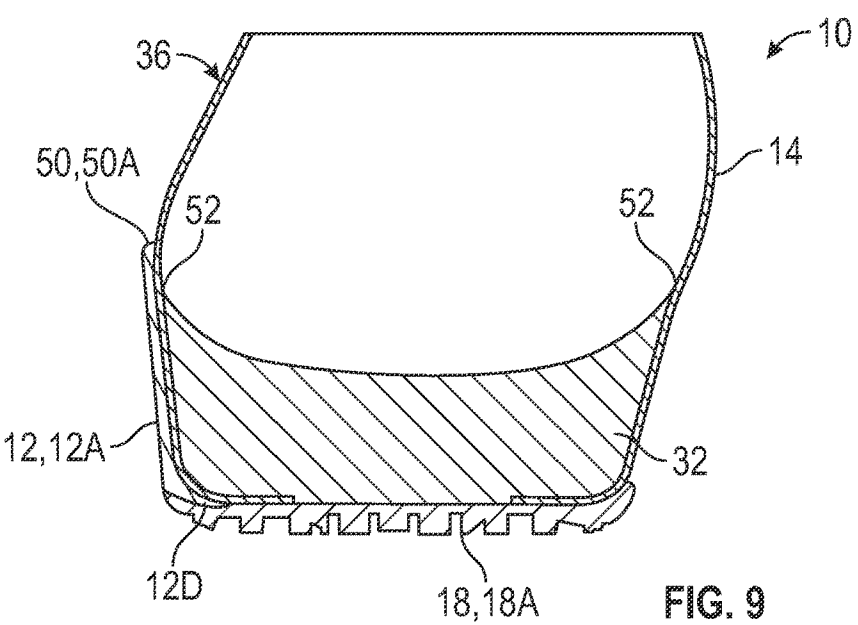
FIG. 9 is a cross-sectional view of the article of footwear of FIG. 1 taken at lines 9-9 in FIG. 1.
Figure 10:
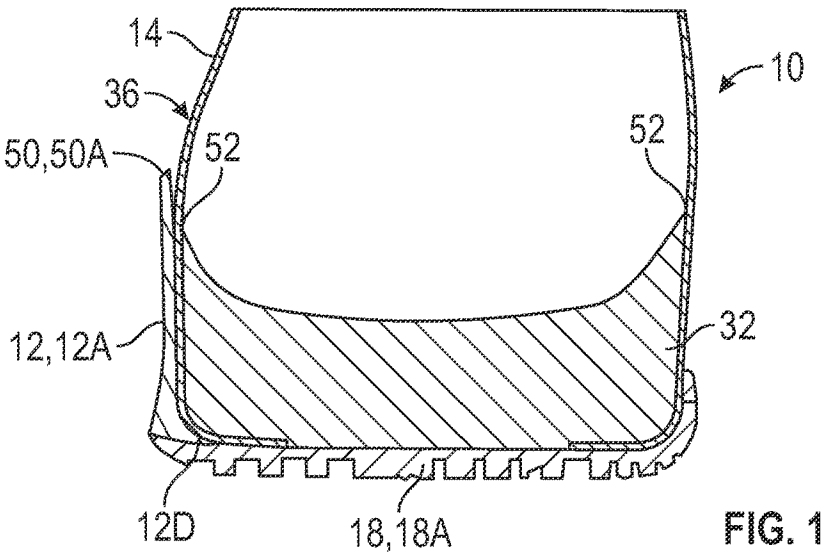
FIG. 10 is a cross-sectional view of the article of footwear of FIG. 1 taken at lines 10-10 in FIG. 1.

To provide greater stability and the ability to mitigate lateral loading (e.g., outward loading of the foot on the upper 14 at the lateral side 28 and/or the medial side 30) thereby helping to keep the foot centered over the midsole 32, a lower extent 12C, 12D of the rand 12 is disposed between the bottom portion 18A of the outsole 18 and the upper 14. Stated differently, the lower extent 12C, 12D of the rand 12 (e.g., a lower extent 12D of the first rand segment 12A and a lower extent 12C of the second rand segment 12B) is sandwiched between and secured to the bottom portion 18A of the outsole 18 and the upper 14. For example, the lower extent 12C, 12D may be bonded to the bottom portion 18A and the upper 14 such as by thermal bonding, adhesive, or otherwise. This is apparent in the cross-sectional views of FIGS. 5, 9, and 10 with respect to the lower extent 12D of the first rand segment 12A, and in FIGS. 6, 7, and 8 with respect to the lower extent 12C of the second rand segment 12B.

The rand 12 extends upward along the exterior surface 36 from the lower extent 12C, 12D to an upper edge 50 of the rand 12. The upper edge 50 includes an upper edge 50A of the first rand segment 12A, and an upper edge 50B of the second rand segment 12B. The rand 12 has a sufficient height such that the upper edge 50 is disposed above (e.g., higher than) an upper peripheral edge 52 of the midsole 32. This is apparent in the cross-sectional views of FIGS. 5, 9, and 10 with respect to the upper edge 50A of the first rand segment 12A, and in FIGS. 6, 7, and 8 with respect to the upper edge 50B of the second rand segment 12B where these are higher than the immediately inward upper peripheral edge 52 of the midsole 32.

Figure 6:
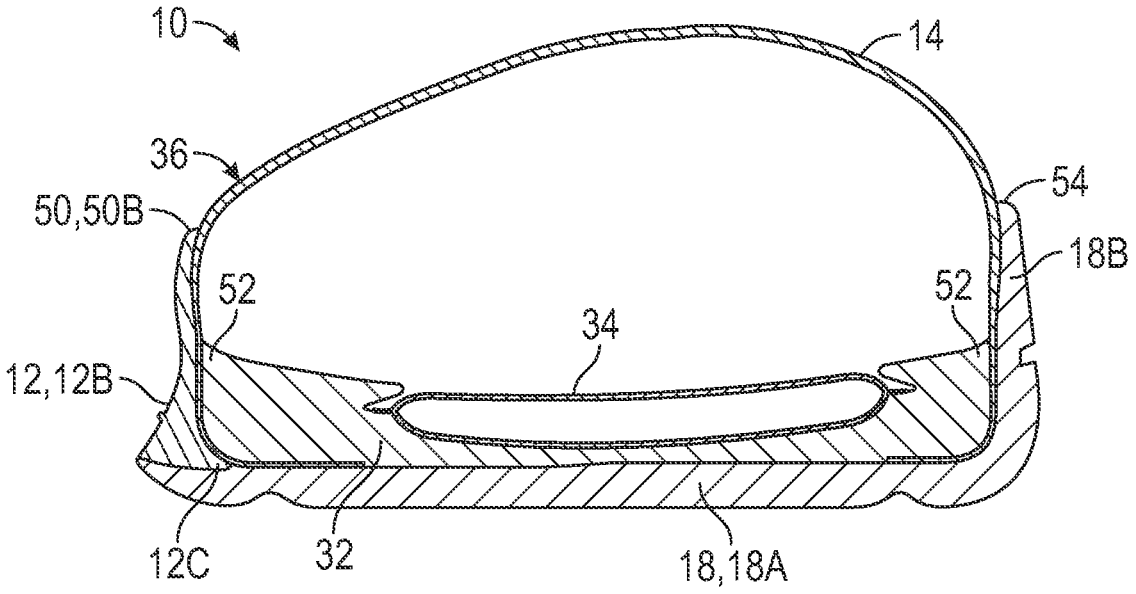
FIG. 6 is a cross-sectional view of the article of footwear of FIG. 1 taken at lines 6-6 in FIG. 1.
Figure 7:
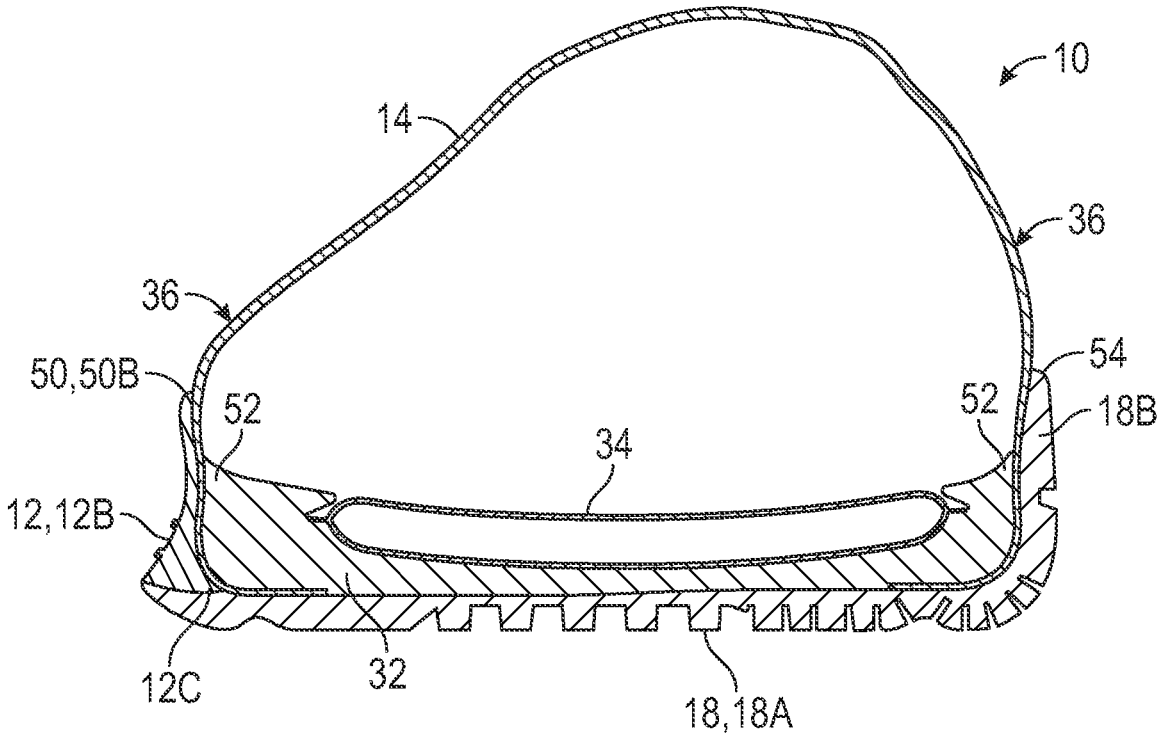
FIG. 7 is a cross-sectional view of the article of footwear of FIG. 1 taken at lines 7-7 in FIG. 1.
Figure 8:
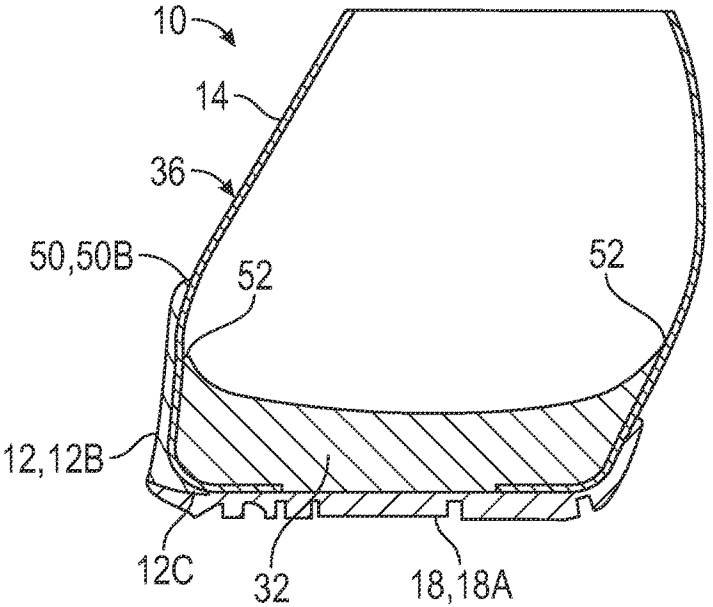
FIG. 8 is a cross-sectional view of the article of footwear of FIG. 1 taken at lines 8-8 in FIG. 1.

Similarly, an upper edge 54 of the sidewall portion 18B of the outsole 18 shown in FIG. 1 is above the upper peripheral edge 52 of the midsole 32 in the forefoot region 22 as shown in FIGS. 5, 6, and 7.

In addition to providing support, the rand 12 has features that enable flexibility of the upper 14 where needed. For example, an edge 60 of the rand 12 at the first end 40 angles upwardly and rearwardly at the medial side 30 of the heel region 26 of the upper 14, as shown in FIG. 2. The upper edge 50B of the rand 12 has a notch 62 at the lateral side 28 of the forefoot region 22 of the upper 14 as shown in FIG. 1. The notch 62 is angular. More specifically, an incline of a leading edge 62A of the notch 62 is steeper than an incline of a trailing edge 62B of the notch 62. This configuration allows the rand 12 to bend and flex with the upper 14, such as during dorsiflexion. For example, the trailing edge 62B will move closer to the leading edge 62A as the notch 62 tends to at least partially close during dorsiflexion.

The sidewall portion 18B of the outsole 18 has a notch 63 with a similar angular shape as the notch 62, and a leading edge 63A and a trailing edge 63B configured like corresponding edges of the notch 62 to provide flexibility in the forefoot region 22 at the medial side 30.

The different segments or portions of the rand 12 may have different properties to provide both support and enable flexibility where needed. The first segment 12A extends from the first end 40 to a first intermediate end 64 at the lateral side 28 of the upper 14. The second segment 12B extends from the second end 42 to a second intermediate end 66 at the lateral side 28 that is adjacent to the first intermediate end 64. For example, the first intermediate end 64 has a forward edge 64A that abuts a rear edge 66A of the second intermediate end 66. The forward edge 64A angles upwardly and rearwardly and the rear edge 66A angles upwardly and rearwardly along the forward edge 64A.

Generally, more flexibility is advantageous in the forefoot region 22 than in the heel region 26 of the footwear 10. For this reason and/or another reason or reasons, the first segment 12A may comprise a first material and the second segment 12B may comprise a second material that is different than the first material. The first material and the second material may both comprise thermoplastic polyurethane. In some examples, the first segment 12A may have a first hardness, and the second segment 12B may have a second hardness less than the first hardness (e.g., at least 5 percent less, or at least 10 percent less, or at least 20 percent less). Hardness may be quantified in any standard manner known to those skilled in the art, such as a Shore A Durometer measured using ASTM D2240-05(2010) standard test method or as an Asker C hardness measured using hardness test JIS K6767 (1976).

In some examples, the first segment 12A may have a first elastic modulus and the second segment may have a second elastic modulus that is less than the first elastic modulus (e.g., at least 5 percent less, or at least 10 percent less, or at least 20 percent less). A lower hardness and/or a lower elastic modulus enables greater flexibility in the forefoot region 22 where a majority of the second segment 12B is disposed. Although the sidewall portion 18B of the outsole 18 may be a material that may be less flexible than the first portion 12A of the rand 12, and less flexible than the second portion 12B of the rand 12, the sidewall portion 18B provides durability at the front 44 and medial side 30 of the forefoot region 22 where contact may be made with the ground, such as when dragging the footwear 10 during a lateral move in tennis, for example. In a non-limiting example, the outsole 18 may be formed from materials that may generally include natural or synthetic rubber or other suitably durable materials. The material or materials for the outsole 18 may be selected to provide a desirable combination of durability and flexibility. Synthetic rubbers that may be used include polybutadiene rubber, ethylene propylene rubber (EPR), styrene isoprene styrene (SIS) copolymer rubber, and styrene butadiene rubber.

The first portion 12A of the rand 12 thus has at least one material property different than the second portion 12B of the rand 12, with the first portion 12A secured to at least a first region (e.g., the heel region 26) of the exterior surface 36 of the upper 14, and the second portion 12B secured to at least a second region (e.g., the forefoot region 22) of the exterior surface 36 of the upper 14, with the second portion 12B not secured to the first region, and the first portion 12A not secured to the second region.

In one example, the first material and the second material may both comprise elastomers. For example, the first material may comprise a first elastomer and the second material may comprise a second elastomer. The first elastomer or the second elastomer or both the first elastomer and the second elastomer may individually be a thermoplastic elastomer. For example, the thermoplastic elastomer may be chosen from a thermoplastic styrenic block copolymer, a thermoplastic polyolefin, a thermoplastic polyurethane, and combinations thereof.

The first portion 12A may be referred to as or may include a first rand region and the second portion 12B may be referred to as or may include a second rand region. The first rand region may comprise a first rand material comprising a first elastomer, and the second rand region may comprise a second rand material comprising a second elastomer. The properties of the first rand material and the second rand material differ from each other based on hardness and/or elastic modulus. Optionally, the first and second rand materials differ from each other based on color, based on transparency/translucency, or both. In some aspects, the type or types of elastomers present in the first rand material and the second rand material differ from each other based on the types of elastomers present. In other aspects, the first rand material and the second rand material comprise one or more elastomers of the same type (e.g., both the first rand material and the second rand material comprise butyl rubber, or comprise isoprene rubber, or comprise thermoplastic polyolefin rubber, or comprise a thermoplastic polyurethane rubber, etc.). In one aspect, the type or types of elastomers present in the first and second rand materials share similar chemistries (e.g., the first and second rand materials include elastomers having the same or similar functional groups, the elastomers were formed from monomers having the same or similar functional groups, and/or the elastomers have the same or similar surface energies), allowing the first and second rand materials to form strong bonds with each other, such as following adhesive bonding, welding or vulcanization processes.

Those skilled in the art will readily understand a variety of methods to determine luminous transmittance and haze of an object, such as any of the rands 12, 112, 212, or the rand portion 318C disclosed herein. For example, the luminous transmittance and haze can be determined according to American Society for Testing and Materials (ASTM) Standard D1003-00, Standard Test Method for Haze and Luminous Transmittance of Transparent Plastics. Luminous transmittance and haze determined according to such a test may be considered as a measurement of the transparency of the rand or rand portion.

Stated still differently, the first portion 12A may comprise a first rand material and the second portion 12B may comprise a second rand material wherein both the first rand material and the second rand material are elastomeric materials. The elastomeric rand materials may each individually comprise at least one elastomer. Examples of elastomers include butyl rubber, isoprene rubber, nitrile rubber, styrenic block copolymer rubber such as styrene-butadiene rubber, polyolefin rubber such as ethylene propylene rubber, silicone rubber, and combinations thereof. In some aspects, the at least one elastomer comprises a thermoset elastomer. In other aspects, the at least one elastomer comprises a thermoplastic elastomer. Examples of thermoplastic elastomers include thermoplastic styrenic block copolymer rubber, thermoplastic vulcanizate rubber, thermoplastic polyolefin rubber, thermoplastic polyurethane rubber, and combinations thereof. In one aspect, the at least one elastomer comprises thermoplastic polyurethane rubber.

Figure 11:
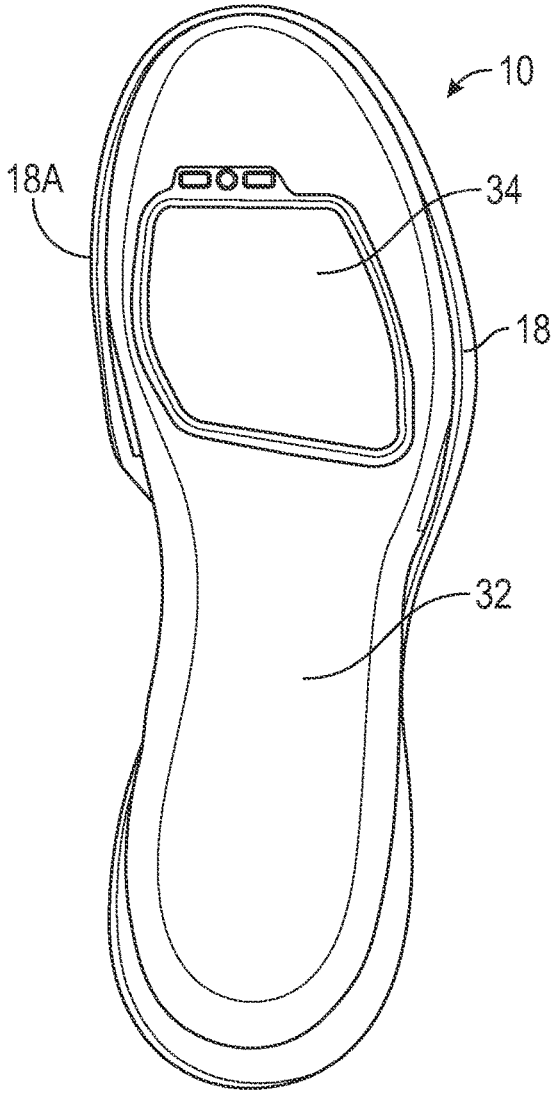
FIG. 11 is a top view of the article of footwear of FIG. 1 with the upper and the rand not shown for clarity.
Figure 12:
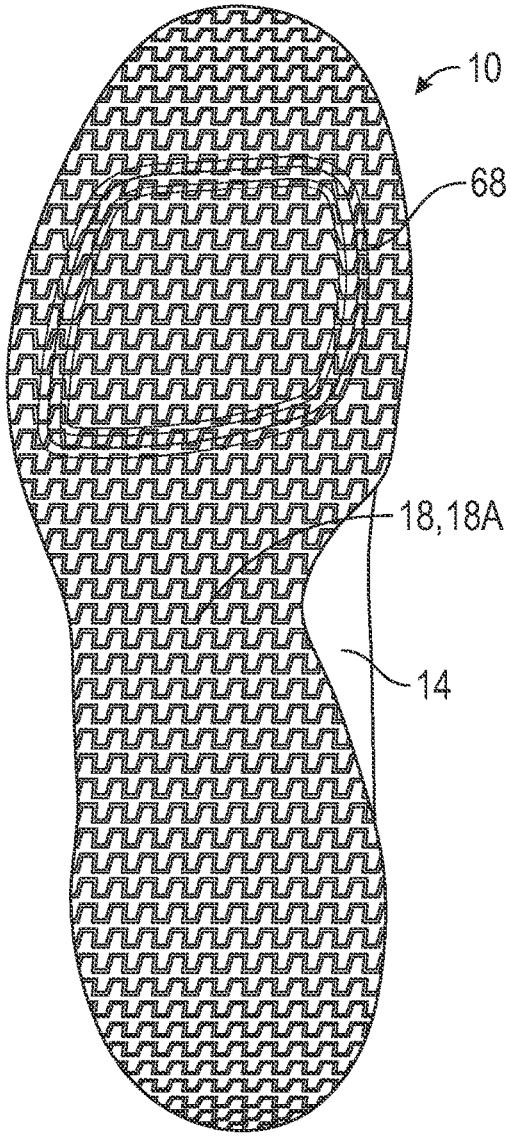
FIG. 12 is a bottom view of the article of footwear of FIG. 1.

FIG. 11 provides a top view of the midsole 32, outsole 18, and bladder 34 with the upper 14 and rand 12 removed. FIG. 12 provides a bottom view of the article of footwear 10, showing the bottom portion 18A of the outsole 18. The outsole 18 may have a recession 68 that generally encircles the area directly below the bladder 34. This may further help to direct impact forces in the forefoot region 22 of the bottom portion 18A toward the bladder 34 for absorption and reaction.

Figure 13:
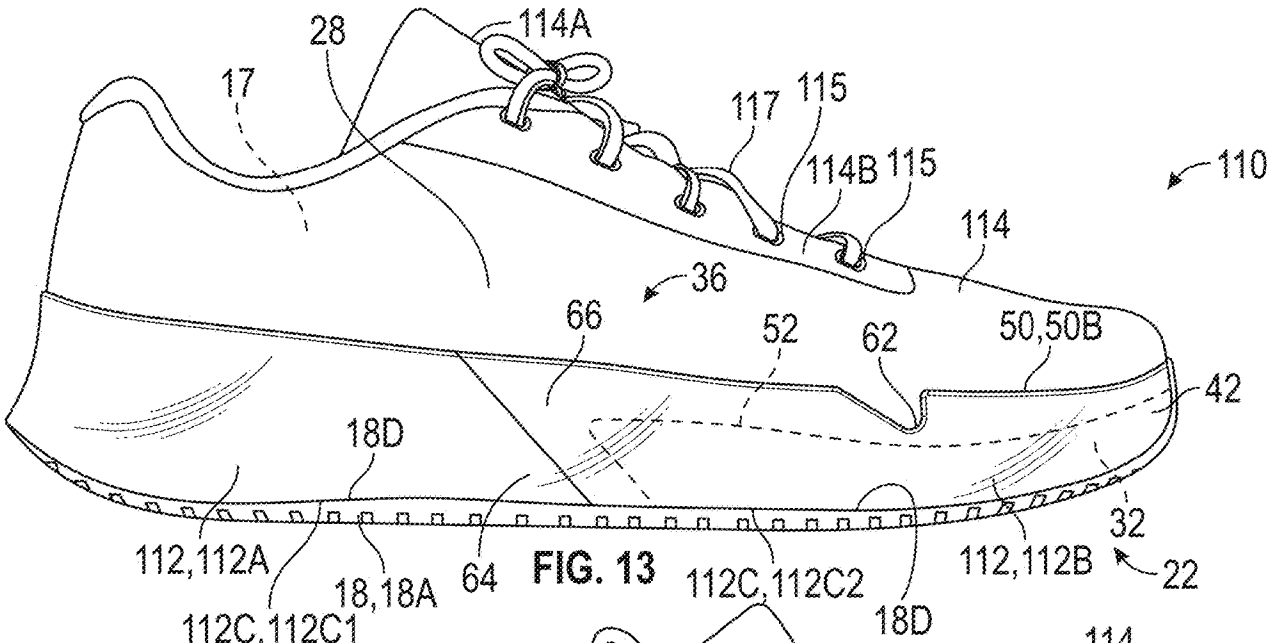
FIG. 13 is a lateral side view of another embodiment of an article of footwear having a rand that is transparent.
Figure 14:
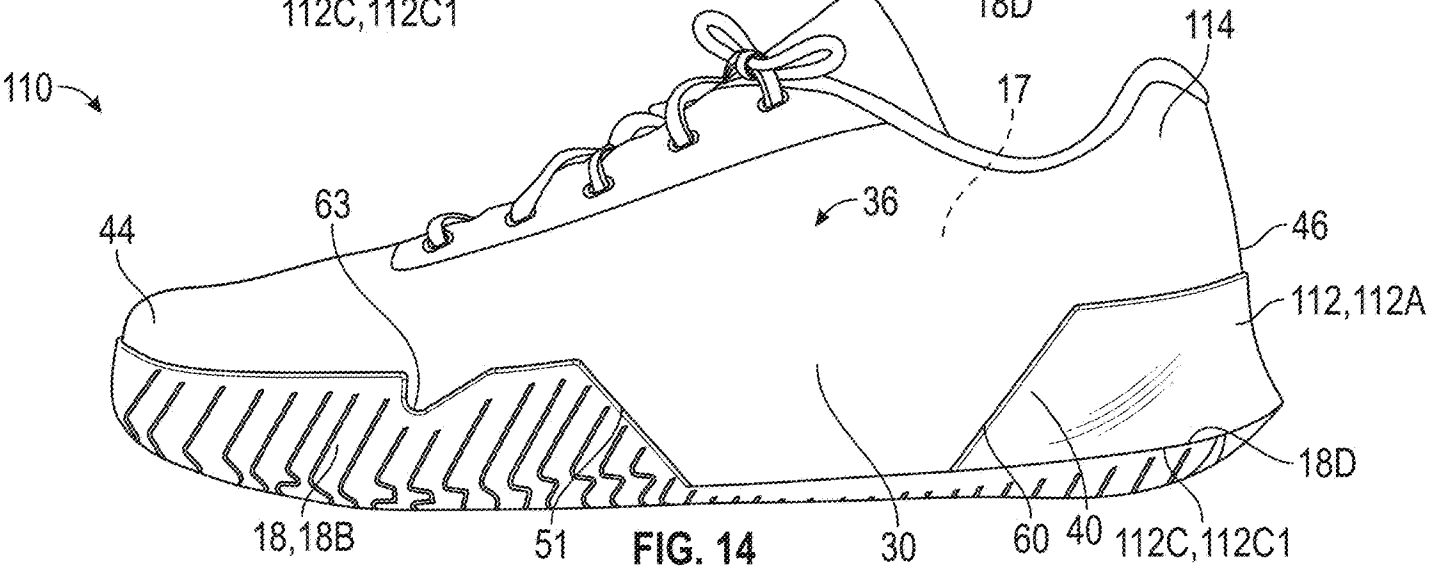
FIG. 14 is a medial side view of the article of footwear of FIG. 13.

FIGS. 13 and 14 show an article of footwear 110 that is alike in many aspects to the article of footwear 10. The article of footwear 110 has an upper 114 that defines the foot-receiving cavity 17 over the outsole 18 in the same manner as the upper 14. The upper 114 is shown with a tongue 114A and with an eyestay 114B having eyelets 115 with a lace 117 extending therethrough.

The article of footwear 110 has a rand 112 with a first segment 112A configured like the first segment 12A, and with a second segment 112B configured like the second segment 12B. The first and second segments 112A and 112B are at least partially transparent in the embodiment shown. The upper 114 may or may not extend downward to the bottom portion 18A of the outsole 18 in the forefoot region 22 on the medial side 30. If the upper 114 does not extend downward to the bottom portion 18A of the outsole 18 in the forefoot region 22 on the medial side 30, it may instead be secured to a foot-facing surface of the midsole 32. As can be seen through the transparent second segment 112B in FIG. 13, the upper edge 50B of the second segment 112B is above the upper peripheral edge 52 of the midsole 32 as in the article of footwear 10. The rand 112 is separate from the outsole 18, and a lowermost edge 112C of the rand 112 extends along an upper edge 18D of the outsole 18 as shown in FIG. 13. The lowermost edge 112C of the rand 112 includes a lowermost edge 112C1 of the first rand segment 112A and a lowermost edge 112C2 of the second rand segment 112B. The rand 112 is secured to an exterior surface 26 of the upper 114. The rand 112 has a first end 40 at a medial side 30 of a heel region of the upper 114 and a second end 42 at a front 44 of a forefoot region of the upper 114. The rand 112 includes the first segment 112A and the second segment 112B nonintegral with the first segment 112A. The rand 112 wraps around a rear 46 of the upper 114 from the first end 40 to the second end 42, the rand extending along a lateral side 28 of the upper from the first end 40 to the second end 42. The outsole 18 wraps upward onto the exterior surface of the upper 114 at a medial side 30 of the forefoot region (e.g., at the sidewall portion 18B).

Figure 17:
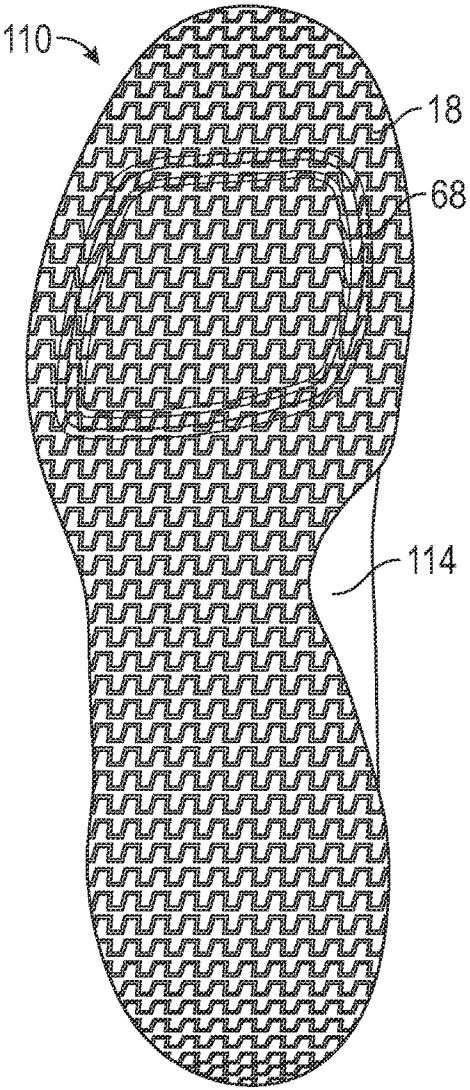
FIG. 17 is a bottom view of the article of footwear of FIG. 13.
Figure 16:
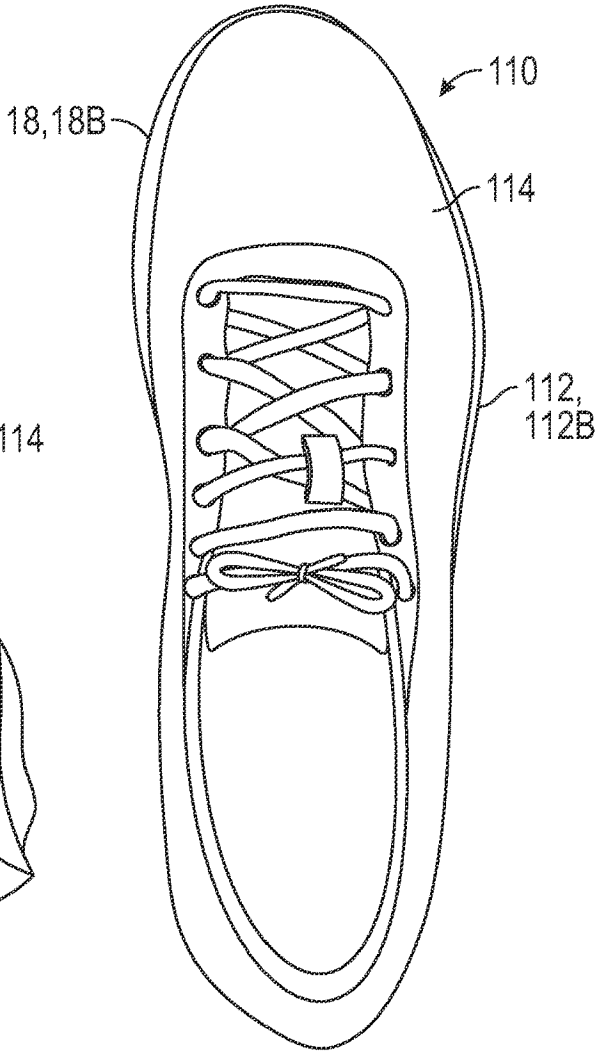
FIG. 16 is a top view of the article of footwear of FIG. 13.
Figure 15:
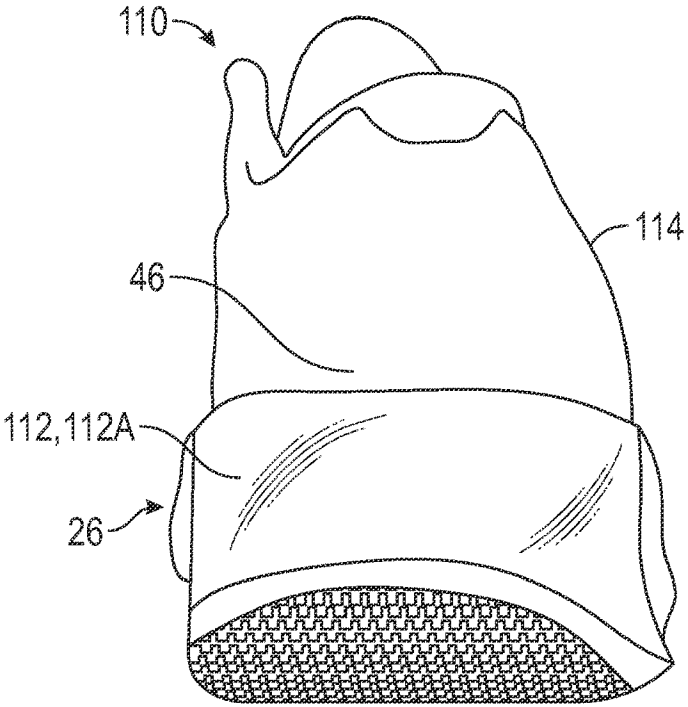
FIG. 15 is a rear view of the article of footwear of FIG. 13.

FIG. 15 shows the transparent first segment 112A wrapping around the rear 46 of the upper 114 in the heel region 26. FIGS. 16 and 17 show top and bottom views of the article of footwear 110, respectively.

The first and second segments 12A, 12B of the rand 12 of FIG. 1 may be two separate components having different properties as described above and may simply abut one another at the edges 64A, 66A to provide a continuous expanse of coverage of the lower extent of the upper 14 from the first end 40 to the second end 42. Similarly, the first and second segments 112A, 112B of the rand 112 may be two separate components. Alternatively, the first and second segments 12A, 12B and/or the first and second segments 112A, 112B may be co-molded or otherwise joined as a single, unitary, one-piece component.

Figure 20:
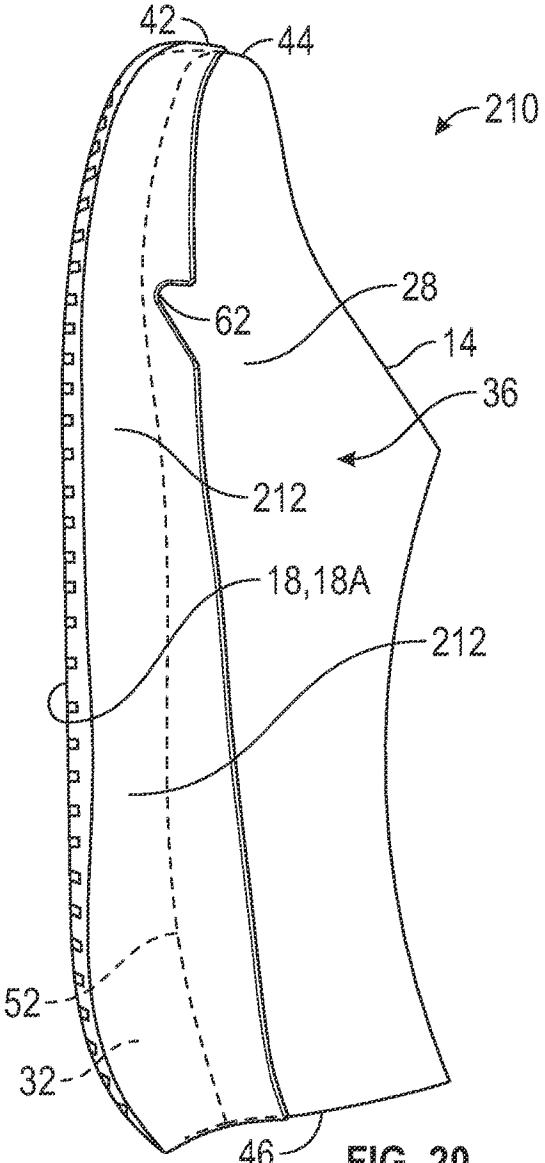
FIG. 20 is a lateral side view of the article of footwear of FIG. 18.
Figure 19:
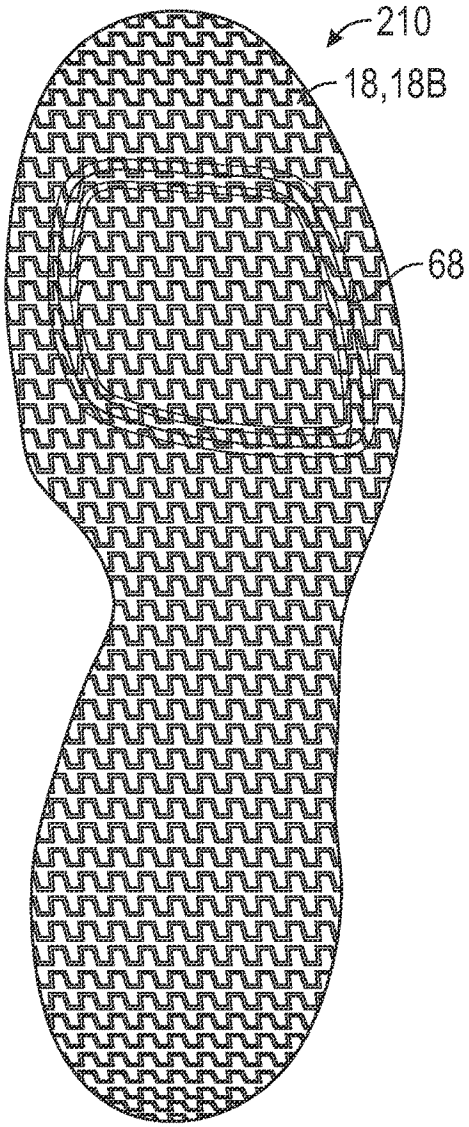
FIG. 19 is a bottom view of the article of footwear of FIG. 18.
Figure 18:
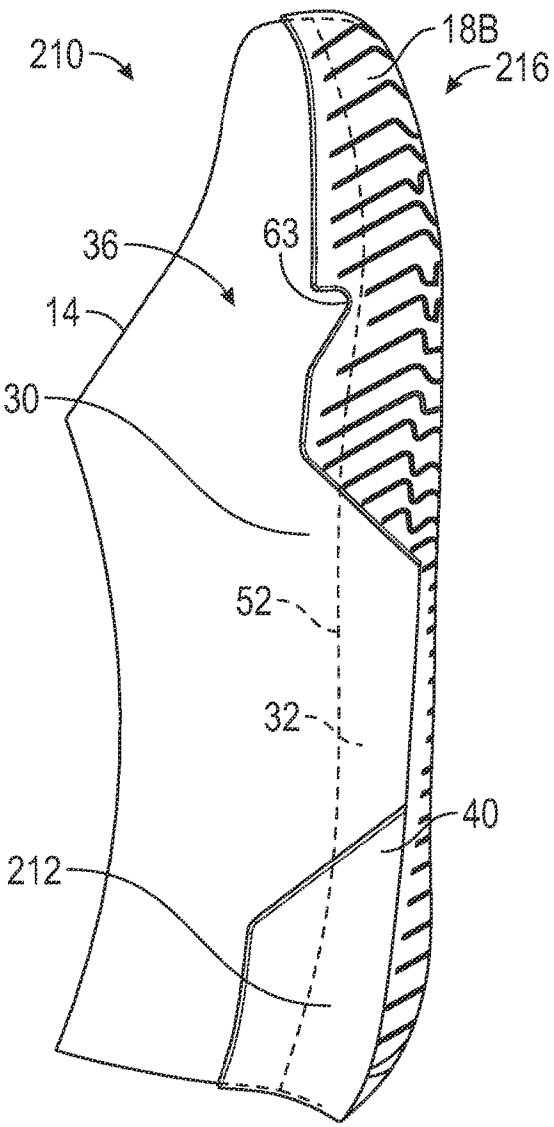
FIG. 18 is a medial side view of another embodiment of an article of footwear having a one-piece rand.

FIGS. 18-20 show an article of footwear 210 that includes a sole structure 216 that has the outsole 18 and the midsole 32 as described and has a one-piece rand 212. The article of footwear 210 as shown is configured for a left foot, as FIG. 18 shows the medial side 30 and FIG. 20 shows the lateral side 28. The articles of footwear 10, 110 shown herein are configured for a right foot. As can be seen in FIG. 20, the one-piece rand 212 extends along the lateral side 28 of the lower extent of the upper 14 entirely from the rear 46 to the front 44 without any break. Stated differently, there are no intermediate ends like the intermediate ends 64 and 66 of the rand 12 that has two segments 12A, 12B. Although it is a one-piece rand 212, it may nevertheless have different properties in different portions of the rand 212, similar to the different properties of the different segments 12A, 12B. The rand 212 has the first end 40 and wraps around the rear 46 of the upper 14 to the lateral side 28 and extends along the lateral side 28 to the second end 42 at the front 44, and extends upward along the exterior surface 36 of the upper 14 above the upper peripheral edge 52 of the midsole 32.

Figure 21:
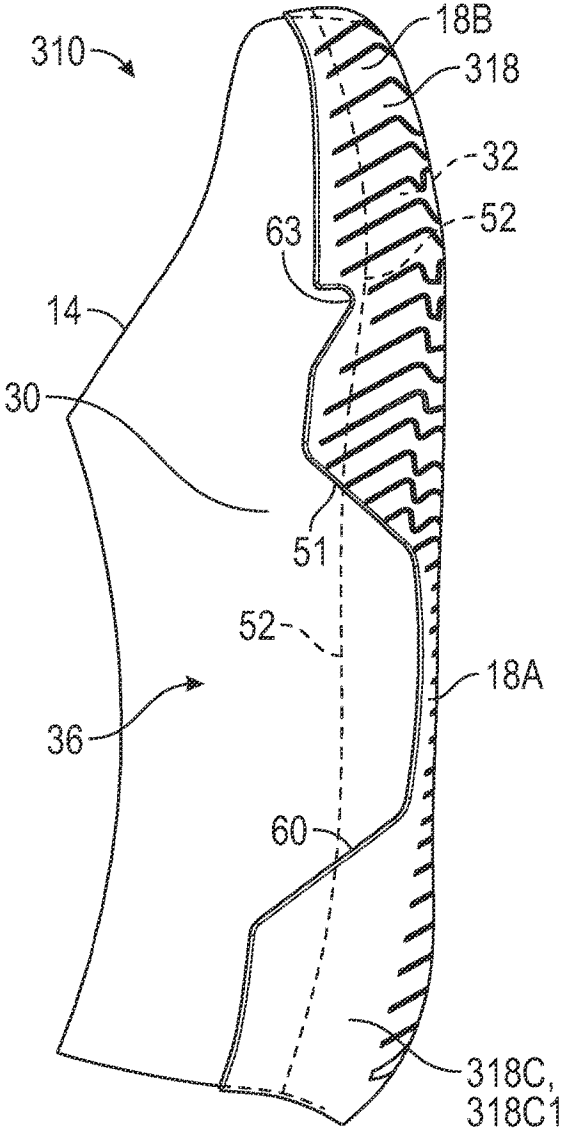
FIG. 21 is a medial side view of another embodiment of an article of footwear having an outsole and rand integrated as a one-piece component.

FIG. 21 is a medial side view of another embodiment of an article of footwear 310, shown as configured for a left foot, and having an outsole 318 with an integral rand portion 318C. Stated differently, the outsole 318 has a bottom portion 18A and a sidewall portion 18B that are mirror images of the bottom portion 18A and the sidewall portion 18B of the outsole 18, but also has a rand portion 318C disposed at the same locations as the rand 12 of the article of footwear 10, but made integral with the bottom portion 18A and sidewall portion 18B as a one-piece component. While the rand portion 318C has edges 51, 60 and a notch 62 in the locations described with respect to the rand 12 of the article of footwear 10, the rand portion 318C has no ends like first end 40 and second end 42 of the rands 12, 112, 212 described herein, and no intermediate ends like intermediate ends 64, 66 of the rands 12, 112, because the rand portion 318C is integrally connected and continuous with the bottom portion 18A and sidewall portion 18B.

Figure 23:
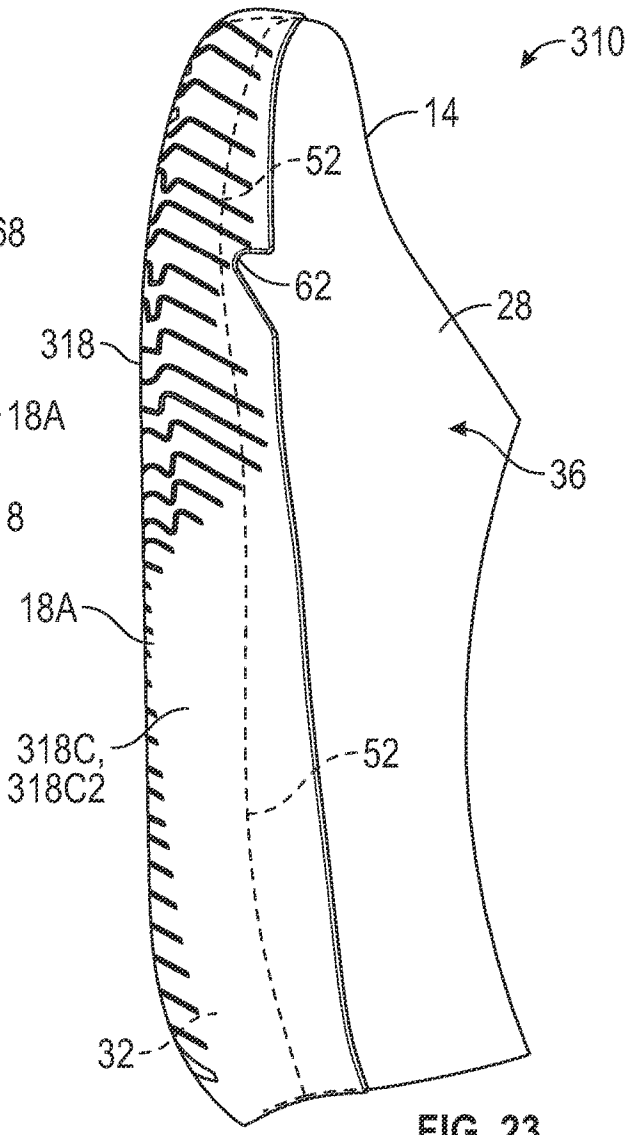
FIG. 23 is a lateral side view of the article of footwear of FIG. 21.
Figure 22:
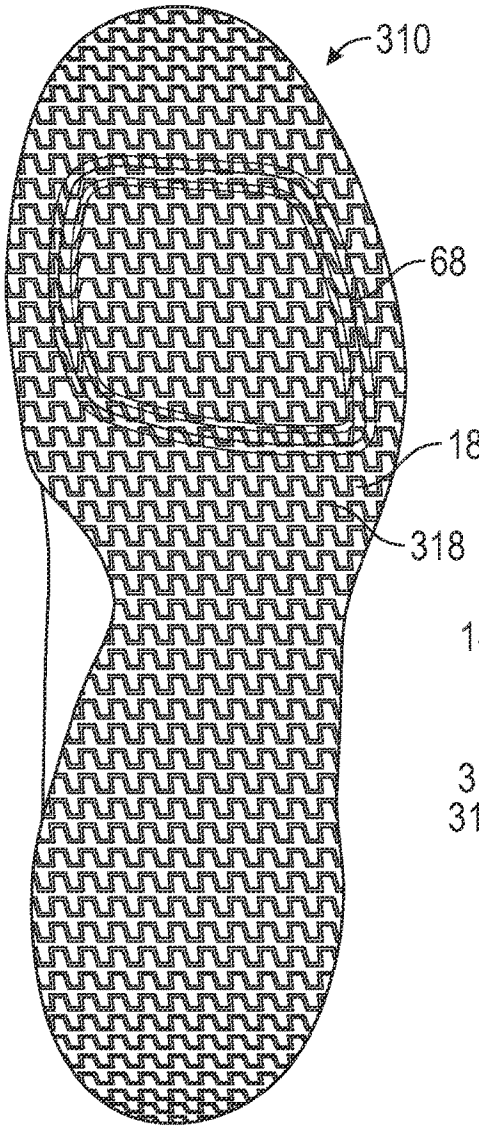
FIG. 22 is a bottom view of the article of footwear of FIG. 21.

FIG. 22 is a bottom view of the article of footwear of FIG. 21, and FIG. 23 is a lateral side view of the article of footwear of FIG. 21. A first region 318C1 of the rand portion 318C of the outsole 318 (e.g., at the medial side 30 near the edge 60) and a second region 318C2 of the rand portion 318C of the outsole 318 (at the lateral side 28) both extend upward along the exterior surface 36 of the upper 14 above the upper peripheral edge 52 of the midsole 32.

A method of manufacturing the rand 12, 112, or 212, or the outsole 318 that includes the rand portion 318C may include molding a first material to form the rand. In some examples, the first material forms a first portion or region of the rand, and the method further includes molding a second material to form a second portion or region of the rand either separately or by co-molding with the first material.

The following Clauses provide example configurations of an article of footwear, a component for an article of footwear, and a method of manufacturing a component for an article of footwear disclosed herein.

Clause 1. An article of footwear comprising: an outsole; an upper secured to the outsole and defining a foot-receiving cavity over the outsole; and a rand secured to an exterior surface of the upper; wherein the rand has a first end at a medial side of a heel region of the upper and a second end at a front of a forefoot region of the upper; wherein the rand wraps around a rear of the upper from the first end to the second end, the rand extending along a lateral side of the upper from the first end to the second end.

Clause 2. The article of footwear of clause 1, wherein a lower extent of the rand is disposed between the outsole and the upper.

Clause 3. The article of footwear of any of clauses 1-2, further comprising: a midsole disposed within the foot-receiving cavity and having an upper peripheral edge; wherein the rand extends upward along the exterior surface of the upper above the upper peripheral edge.

Clause 4. The article of footwear of any of clauses 1-3, wherein the outsole wraps upward onto the exterior surface of the upper at a medial side of the forefoot region.

Clause 5. The article of footwear of clause 4, wherein the outsole wraps upward onto the exterior surface of the upper at the front of the forefoot region, and the second end of the rand meets the outsole at the front of the forefoot region.

Clause 6. The article of footwear of any of clauses 1-5, wherein the rand has an edge at the first end that angles upwardly and rearwardly at the medial side of the heel region of the upper.

Clause 7. The article of footwear of any of clauses 1-6, wherein the rand has an upper edge with a notch at the lateral side of the forefoot region of the upper.

Clause 8. The article of footwear of clause 7, wherein the notch is angular.

Clause 9. The article of footwear of any of clauses 7-8, wherein an incline of a leading edge of the notch is steeper than an incline of a trailing edge of the notch.

Clause 10. The article of footwear of any of clauses 1-9, wherein the rand is a one-piece component.

Clause 11. The article of footwear of any of clauses 1-10, wherein the rand is at least partially transparent.

Clause 12. The article of footwear of any of clauses 1-11, wherein: the rand includes a first segment and a second segment; the first segment extends from the first end to a first intermediate end at the lateral side of the upper; the second segment extends from the second end to a second intermediate end at the lateral side of the upper; and the second intermediate end is adjacent to the first intermediate end.

Clause 13. The article of footwear of clause 12, wherein the first intermediate end has a forward edge that abuts a rear edge of the second intermediate end.

Clause 14. The article of footwear of clause 12, wherein: the first intermediate end has a forward edge that angles upwardly and rearwardly; and the second intermediate end has a rear edge that angles upwardly and rearwardly along the forward edge of the first intermediate end.

Clause 15. The article of footwear of clause 12, wherein the first segment comprises a first material and the second segment comprises a second material different than the first material.

Clause 16. The article of footwear of clause 15, wherein the first material comprises a first elastomer and the second material comprises a second elastomer, optionally wherein the first elastomer or the second elastomer or both the first elastomer and the second elastomer are individually a thermoplastic elastomer, optionally wherein the thermoplastic elastomer is chosen from a thermoplastic styrenic block copolymer, a thermoplastic polyolefin, a thermoplastic polyurethane, and combinations thereof.

Clause 17. The article of footwear of clause 16, wherein the first material and the second material both comprise thermoplastic polyurethane.

Clause 18. The article of footwear of clause 12, wherein: the first segment has a first hardness; and the second segment has a second hardness less than the first hardness.

Clause 19. The article of footwear of clause 12, wherein: the first segment has a first elastic modulus; the second segment has a second elastic modulus; and the second elastic modulus is less than the first elastic modulus.

Clause 20. The article of footwear of clause 12, wherein the first segment and the second segment are at least partially transparent.

Clause 21. An article of footwear comprising: an outsole; an upper secured to the outsole and defining a foot-receiving cavity over the outsole; a rand having a first portion and a second portion; wherein the first portion of the rand has at least one material property different than the second portion of the rand; wherein the first portion of the rand is secured to at least a first region of an exterior surface of the upper, the second portion of the rand is secured to at least a second region of the exterior surface of the upper, the second portion of the rand is not secured to the first region, and the first portion of the rand is not secured to the second region.

Clause 22. The article of footwear of clause 21, wherein the at least one material property of the first portion of the rand different than the second portion of the rand is hardness or elastic modulus.

Clause 23. The article of footwear of any of clauses 21-22, wherein the first portion comprises a first material and the second portion comprises a second material different than the first material.

Clause 24. The article of footwear of clause 23, wherein the first material and the second material both comprise elastomers.

Clause 25. The article of footwear of clause 23, wherein the first material and the second material both comprise thermoplastic polyurethane.

Clause 26. The article of footwear of any of clauses 21-25, further comprising: a midsole disposed within the foot-receiving cavity and having an upper peripheral edge; wherein the first portion and the second portion both extend upward along the exterior surface of the upper above the upper peripheral edge.

Clause 27. An article of footwear comprising: an outsole; an upper secured to the outsole and defining a foot-receiving cavity over the outsole; and a midsole disposed within the foot-receiving cavity and having an upper peripheral edge; wherein the outsole has an integral rand portion that wraps up along an exterior surface of the upper outward of the midsole and extends above the upper peripheral edge of the midsole.

Clause 28. A component of an article of footwear, comprising: a rand configured to be secured to an exterior surface of an upper for an article of footwear; wherein the rand has a first end configured to be secured at a medial side of a heel region of the upper and a second end configured to be secured at a front of a forefoot region of the upper; wherein the rand is configured to wrap around a rear of the upper from the first end to the second end; and wherein the rand is configured to extend along a lateral side of the upper from the first end to the second end.

Clause 29. The component of clause 28, wherein the rand is a rand according to the article of footwear of any of clauses 1 to 27.

Clause 30. A method of manufacturing a component of an article of footwear according to any of clauses 28 or 29, or an article of footwear according to any of clauses 1 to 27, comprising molding a first material to form the rand.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an outsole;

an upper secured to the outsole and defining a foot-receiving cavity over the outsole; and a rand separate from the outsole, with a lowermost edge of the rand extending along an upper edge of the outsole, and wherein the rand is secured to an exterior surface of the upper; wherein the rand has a first end at a medial side of a heel region of the upper and a second end at a front of a forefoot region of the upper;

wherein the rand includes a first segment and a second segment nonintegral with the first segment;

wherein the rand wraps around a rear of the upper from the first end to the second end, the rand extending along a lateral side of the upper from the first end to the second end; and wherein the outsole wraps upward onto the exterior surface of the upper at a medial side of the forefoot region.

2. The article of footwear of claim 1, wherein a lower extent of the rand is disposed between the outsole and the upper.

3. The article of footwear of claim 1, further comprising:

a midsole disposed within the foot-receiving cavity and having an upper peripheral edge; wherein the rand extends upward along the exterior surface of the upper above the upper peripheral edge.

4. The article of footwear of claim 1, wherein the outsole wraps upward onto the exterior surface of the upper at the front of the forefoot region, and the second end of the rand meets the outsole at the front of the forefoot region.

5. The article of footwear of claim 1, wherein the rand has an upper edge with a notch at the lateral side of the forefoot region of the upper.

6. The article of footwear of claim 5, wherein an incline of a leading edge of the notch is steeper than an incline of a trailing edge of the notch.

7. The article of footwear of claim 1, wherein the rand is at least partially transparent.

8. The article of footwear of claim 1, wherein:

the first segment extends from the first end to a first intermediate end at the lateral side of the upper;

the second segment extends from the second end to a second intermediate end at the lateral side of the upper; and the second intermediate end is adjacent to the first intermediate end.

9. The article of footwear of claim 8, wherein the first intermediate end has a forward edge that abuts a rear edge of the second intermediate end.

10. The article of footwear of claim 8, wherein:

the first intermediate end has a forward edge that angles upwardly and rearwardly; and the second intermediate end has a rear edge that angles upwardly and rearwardly along the forward edge of the first intermediate end.

11. The article of footwear of claim 8, wherein the first segment comprises a first material and the second segment comprises a second material different than the first material.

12. The article of footwear of claim 11, wherein the first material comprises a first elastomer and the second material comprises a second elastomer, wherein the first elastomer or the second elastomer or both the first elastomer and the second elastomer are individually a thermoplastic elastomer, and wherein the thermoplastic elastomer is chosen from a thermoplastic styrenic block copolymer, a thermoplastic polyolefin, a thermoplastic polyurethane, and combinations thereof.

13. The article of footwear of claim 12, wherein the first material and the second material both comprise thermoplastic polyurethane.

14. The article of footwear of claim 8, wherein:

the first segment has a first hardness; and the second segment has a second hardness less than the first hardness.

15. The article of footwear of claim 8, wherein:

the first segment has a first elastic modulus;

the second segment has a second elastic modulus; and the second elastic modulus is less than the first elastic modulus.

16. An article of footwear comprising:

an outsole;

an upper secured to the outsole and defining a foot-receiving cavity over the outsole; and a rand secured to an exterior surface of the upper; wherein the rand has a first end at a medial side of a heel region of the upper and a second end at a front of a forefoot region of the upper;

wherein the rand wraps around a rear of the upper from the first end to the second end, the rand extending along a lateral side of the upper from the first end to the second end;

wherein the rand includes a first segment and a second segment, the first segment extends from the first end to a first intermediate end at the lateral side of the upper, the second segment extends from the second end to a second intermediate end at the lateral side of the upper, and the second intermediate end is adjacent to the first intermediate end;

wherein the first intermediate end has a forward edge that angles upwardly and rearwardly; and wherein the second intermediate end has a rear edge that angles upwardly and rearwardly along the forward edge of the first intermediate end.

17. The article of footwear of claim 16, wherein the first segment comprises a first material and the second segment comprises a second material different than the first material.

* * * * *